US005791548A

United States Patent [19]

Udagawa et al.

[11] Patent Number: 5,791,548

[45] Date of Patent: *Aug. 11, 1998

[54] MOTOR DRIVEN STAPLER

[75] Inventors: Hiroshi Udagawa; Katsunori Manabe; Kunio Ishizaki, all of Tokyo, Japan

[73] Assignee: The Max Co., Ltd., Tokyo, Japan

[ * ] Notice: The term of this patent shall not extend beyond the expiration date of Pat. No. 5,460,314.

[21] Appl. No.: 650,911

[22] Filed: May 17, 1996

Related U.S. Application Data

[63] Continuation of Ser. No. 194,430, Feb. 10, 1994, abandoned.

[30] Foreign Application Priority Data

| | | | |
|---|---|---|---|
| Feb. 10, 1993 | [JP] | Japan | 5-009321 U |
| Feb. 10, 1993 | [JP] | Japan | 5-009322 U |
| Feb. 10, 1993 | [JP] | Japan | 5-009323 U |
| Feb. 10, 1993 | [JP] | Japan | 5-009324 U |

[51] Int. Cl.[6] ..... B25C 5/16; B27F 7/38

[52] U.S. Cl. ..... 227/131; 227/120; 227/135

[58] Field of Search ..... 227/131, 87–89, 227/111, 120, 135, 155

[56] References Cited

U.S. PATENT DOCUMENTS

| | | | |
|---|---|---|---|
| 2,205,861 | 6/1940 | Oussani | 227/131 |
| 2,716,748 | 9/1955 | Sutton | 227/89 |
| 2,977,599 | 4/1961 | Shlesinger, Jr. | 227/131 X |
| 4,199,095 | 4/1980 | Yamanoi | 227/120 X |
| 4,318,555 | 3/1982 | Adamski et al. . | |
| 4,449,661 | 5/1984 | Spehrley, Jr. . | |
| 4,623,082 | 11/1986 | Kurosawa | 227/131 X |
| 4,988,029 | 1/1991 | Fiske . | |
| 5,009,355 | 4/1991 | Akizawa et al. | 227/131 |
| 5,141,143 | 8/1992 | Ebner et al. | 227/131 X |
| 5,181,643 | 1/1993 | Radtke | 227/131 X |
| 5,195,671 | 3/1993 | Shimomura et al. | 227/120 X |
| 5,460,314 | 10/1995 | Udagawa | 227/131 |
| 5,474,222 | 12/1995 | Kanai et al. | 227/131 |

FOREIGN PATENT DOCUMENTS

| | | |
|---|---|---|
| 475436 | 3/1992 | European Pat. Off. . |
| 485846 | 5/1992 | European Pat. Off. . |
| 579118 | 1/1994 | European Pat. Off. . |
| 1156880 | 10/1989 | Japan . |
| 2219601 | 9/1990 | Japan . |
| 4129679 | 4/1992 | Japan . |
| 2126147 | 3/1984 | United Kingdom . |

OTHER PUBLICATIONS

EPO DE2815551 Abstract.

EPO DE2822692 Abstract.

J. J. Ferrara, "Staple Stack Separator", Xerox Disclosure Journal, vol. 12, No. 6, Nov./Dec. 1987 pp. 297–298.

M.J. Russell et al. "Staple Sensing Apparatus", Research Disclosure, No. 157, May 1, 1977, pp. 22–23.

*Primary Examiner*—Rinaldi I. Rada
*Assistant Examiner*—Boyer Ashley
*Attorney, Agent, or Firm*—Morgan, Lewis & Bockius LLP

[57] ABSTRACT

A feed roller 32 is disposed in a magazine section 1 such that the feed roller 32 is in press contact with the lower side of a sheet-like staple fed out of a cartridge 13. A rack is formed in the support means of the magazine section 1. The feed roller 32 is operatively coupled with the magazine section 1 through a one-way clutch gear 34 in mesh with the rack 33. Only when the magazine section 1 separates from the clincher section 4, the one-way clutch gear 34 operates to rotate the feed roller 32 in the staple supply direction. The rotation of the one-way clutch gear 34 can be adjusted by a gear ratio of the combination of the one-way clutch gear 34 and the rack 33. Therefore, a sufficient quantity of feeding the sheet-like lowest staple is secured. The feed roller 32 is rotated by utilizing the forward/backward motion of the magazine section 1 with respect to the clincher section. Therefore, provision of any special drive means for rotation is not required.

13 Claims, 13 Drawing Sheets

MOTOR DRIVEN STAPLER

This is a continuation of application Ser. No. 08/194,430, filed Feb. 10, 1994, now abandoned.

BACKGROUND OF THE INVENTION

The present invention relates to a staple supply mechanism for a motor-driven stapler in which a cartridge containing a stack of sheet-like staples, each consisting of a series of glued staple pieces, is removably mounted on a magazine body, and the sheet-like lowest staple is fed forward from the cartridge by the forward/backward motion of the magazine section with respect to the clincher section in driving out the staple piece.

The present invention also relates to a control mechanism for a motor-driven stapler having a magazine section including a driver plate for cutting off by punching a staple piece from a staple, and a clincher section including movable clinchers for bending the legs of the staple piece flat, the control mechanism controlling the operations of the magazine section and clincher section.

The present invention further relates to a positioning mechanism in use in a stapler having separately a staple driving section and a clincher section having a clincher groove for clinching the driven staple piece flat.

A staple driving mechanism in which a cartridge containing a stack of sheet-like staples each consisting of a series of glued staple pieces is removably mounted on a magazine body, and the sheet-like lowest staple is fed forward from the cartridge in driving out the staple piece, is known as disclosed in Published Unexamined Japanese Utility Model Application No. Hei. 1-156880 and Published Unexamined Japanese Patent Application No. Hei. 4-129679.

In the former publication, a feed belt is disposed under the cartridge to contact the lowest staple a1 of a staple stack within the magazine. The lowest staple is fed forward by moving the feed belt. In the latter publication, a roller is used for the same purpose, in lieu of the belt.

These techniques are both based on the use of friction between the feeding means and the lowest staple to feed the staple. For this reason, the staple feeding operation tends to be unstable. The lowest staple contacts the feeding means with more staples placed thereon. As a result, the friction force is strong and leads to an insufficient feeding of the staple.

In addition, in a conventional motor-driven stapler with movable clinchers, a staple punching section (magazine section) and a clincher section are mounted on a frame. The movable clinchers are driven by using a drive mechanism installed in the punching section.

The magazine section is turned about a fulcrum. The driver plate of the magazine section also is turned in a circular arc when a staple piece is punched down toward the clincher section. When stapling thin papers, the driver plate moves toward the papers almost at a right angle to the paper surface, and a position where the end of the driver plate comes in contact with the paper surface is close to the fulcrum. When stapling thick papers, the driver plate moves toward the papers at an angle smaller than the right angle, and the position where the end of the driver plate comes in contact with the paper surface is located further from the fulcrum.

In the stapler of the type in which the staple punching section is turned, it is impossible to know exactly whether or not the staple piece driven by the driver plate have passed through a set of papers, from the number of revolutions of the motor. Thus, the movable clinchers are frequently operated at an improper timing.

A conventional stapler in which the bases of the staple driving section and the clincher section are rotatably coupled with each other is known. In this type of the stapler, papers, when for stitching, are inserted into the space between the driving section and the clincher section. After they are stitched, the papers are pulled out therefrom in the opposite direction.

In some recent copying machines, copied papers are discharged after being stitched by a stapler. Where a conventional stapler is assembled into the copying machine, papers are inserted into the space between the driving section and the clincher section. After they are stitched, the papers are pulled out therefrom in the opposite direction, and transported to the discharge side. Thus, a mechanism capable of handling the different advancing directions of the papers is required. This mechanism is more complicated in construction than one handling the unidirectional advancement.

The simple movement of the papers to be stitched may be achieved in a manner that the driving section and the clincher section are separated so as to allow the papers to pass therebetween, and the stitched papers are moved in the same direction as when they are inserted for stitching.

When the motor-driven stapler having the separated sections is attached to other equipment, such as the copying machine, those sections must be positioned so as to be aligned with each other as required.

SUMMARY OF THE INVENTION

To overcome the defect of the conventional technique, an object of the present invention is to provide a staple supply mechanism in a motor-driven stapler which can reliably feed stacked sheet-like lowest staples out of a cartridge.

A control mechanism for a motor-driven stapler, according to a first aspect of the present invention, has a magazine section including a driver plate for driving down a staple piece from a sheet-like staple supplied from a staple holder, a clincher section including a movable clincher for clinching flat the legs of the staple piece driven down, wherein the magazine section includes a pusher standing facing the rear end of the lowest staple of the staple stack in the cartridge, a roller that is brought into press contact with the surface of the pusher, a drive gear for transferring a rotation force to the roller, and a rack member, which is in mesh with a drive gear, is disposed on the rear side of the magazine section, said rack member rotating the drive gear by making use of the forward/backward relative motion of the magazine section to the clincher section in driving out the staple piece.

In such an arrangement, when the magazine section moves away from the clincher section after the staple piece is driven down, the drive gear, which is in mesh with the rack of the rack member, and the roller both rotate. With the rotation of the roller, the pusher being pressed against the roller is moved forward. The fore end of the pusher contacts the rear end face of the sheet-like lowest staple in the cartridge. The sheet-like lowest staple is fed forward along the staple guide.

In a stapling mode, the magazine section approaches the clincher section. The gear in mesh with the rack member is turned in reverse and the pusher is moved backward.

Thus, in the first aspect of the present invention, the pusher pushes the rear end face of the sheet-like lowest staple within the cartridge. Therefore, a reliable feed of the lowest staple is secured. The extent of the movement of the pusher is determined by the rotation of the drive gear in mesh with the rack of the rack member. The rotation of the drive gear can be adjusted as desired by properly selecting a gear ratio of the combination of the rack and the drive gear. Thus, a reliable initial feed of the lowest staple a1 is secured.

In addition, to achieve the above object, a motor-driven stapler is provided of the type, according to a second aspect of the present invention, in which a cartridge containing a stack of sheet-like staples, each consisting of a series of glued staple pieces, is removably mounted on a magazine section, and in driving down the staple piece, the magazine section is supported by a support means so that the magazine section is moved to and away from the clincher section. Also, sheet-like lowest staple of the stacked sheet-like staples is fed out of the cartridge, and the foremost staple piece of the sheet-like lowest staple is shaped and driven out toward the clincher section, wherein a feed roller is disposed in the magazine section such that the feed roller is in press contact with the lower side of the sheet-like staple fed out of the cartridge at the front position of the cartridge, and a rack is formed in the support means of the magazine section, wherein the feed roller is operatively coupled with the magazine section through a one-way clutch gear in mesh with the rack in such a manner that only when the magazine section is moved separating from the clincher section, the one-way clutch gear operates to rotate the feed roller in the staple supply direction.

With such a construction, when the magazine section moves away from the clincher section, the one-way clutch gear rotates to turn the feed roller in the direction in which the sheet-like staple is forwarded. When the magazine section moves toward the clincher section, the one-way clutch gear does not rotate, and hence the feed roller does not rotate.

Thus, the feed roller rotates always in the direction in which the sheet-like staple is fed forward, under control of the one-way clutch gear. In other words, the reverse feed of the sheet-like staple is prohibited. Accordingly, a smooth supply of the sheet-like staple is secured.

The rotation of the feed roller results from the rotation of the one-way clutch gear. The rotation of the one-way clutch gear can be adjusted by a gear ratio of the combination of the one-way clutch gear and the rack. Therefore, a sufficient quantity of feeding the sheet-like lowest staple is secured.

The feed roller is rotated by utilizing the forward/backward motion of the magazine section with respect to the clincher section. As a result, special drive means for rotation is not required, leading to simple construction and reduction of a rate of failure occurrence.

To overcome the disadvantage of the conventional stapler, another object of the present invention is to provide a control mechanism for a motor-driven stapler which can exactly staple a set of papers irrespective of the thickness of the set of papers. After a staple piece is punched by the driver plate to pass through the set of papers, the legs are bent flat by the movable clinchers.

To achieve the above object, a control mechanism for a motor-driven stapler is provided according to a third aspect of the present invention, having a magazine section including a driver plate for driving down a staple piece from a sheet-like staple supplied from a staple holder, and a clincher section including a movable clincher for clinching flat the legs of the staple piece driven down, wherein the magazine section includes a drive mechanism for moving the magazine section so that when the magazine section is aligned with the clincher section, the lower surface of the magazine section is brought into contact with the surface of a set of papers to be stitched, and for driving the driver plate, the clincher section includes another drive mechanism for driving a movable clincher, and a control means for driving the drive mechanism for the movable clincher to start its operation when the legs of the staple piece pass through the set of papers.

The drive mechanism of the magazine section drives the magazine section to move down until it contacts with the paper surface. The driver plate hammers down a staple piece toward the set of papers, so that the legs of the staple piece pass through the set of papers. At this time, the drive mechanism of the clincher section causes the movable clincher to bend the legs of the staple piece flat, and the stapling operation completes.

As described above, in the motor-driven stapler, two drive mechanisms independently operable are provided, one for the magazine section and the other for the clincher section. In operation, the magazine section operates to drive the staple piece through the set of papers. At the instant that the staple piece is put through the set of papers, the drive mechanism of the clincher section operates. Accordingly, the stitching operation proceeds with little influence by any variation of the motor speed of the motor and an excellent stapling is achieved.

For the above background reasons, the present invention has an object to provide a positioning mechanism in use in a separation type stapler which enables the driving section and the clincher section to be attached to other equipment in a required aligned state.

To achieve the above object, a stapler, according to a fourth aspect of the present invention, having separately a driving section for driving a sheet-like staple consisting of glued staple pieces by a driving mechanism and a clincher section having a clincher groove for clinching the legs of the driven staple piece flat, is improved such that it includes at least three positioning holes for positioning the driving section and the clincher section to align them with each other, and pins to be inserted into the positioning holes for positioning the driving section and the clincher section in alignment.

In constructing a motor-driven stapler having the driving section and the clincher section attached to specific locations of other equipment, such as a copying machine, the pins are fit into the positioning holes of the driving section and the clincher section. As a result, the driving section and the clincher section are positioned to be aligned with each other as required. In this aligned state, the driving section and the clincher section are attached to other equipment.

In operation, papers to be stitched are set between the driving section and the clincher section and the stapler is operated. The driver of the driving section slides down, hammers down a staple piece toward the papers. The staple piece is put through the papers. The legs of the staple piece are pressed against the clincher groove to be bent flat. As a result, the papers are stitched. The stitched papers are discharged outside through the space between the driving section and the clincher section.

Even in the motor-driven stapler of the type in which the driving section and the clincher section are separated, if it incorporates the positioning mechanism as described above thereinto, those separated sections can easily be positioned as required by using the pins. Accordingly, the motor-driven stapler can be attached to other equipment so that those sections are accurately positioned.

BRIEF DESCRIPTION OF THE PREFERRED EMBODIMENTS

Figure 4A:
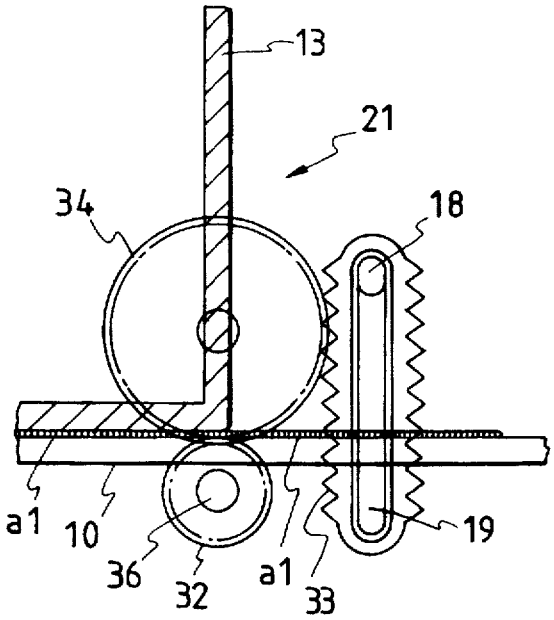
Figure 4B:
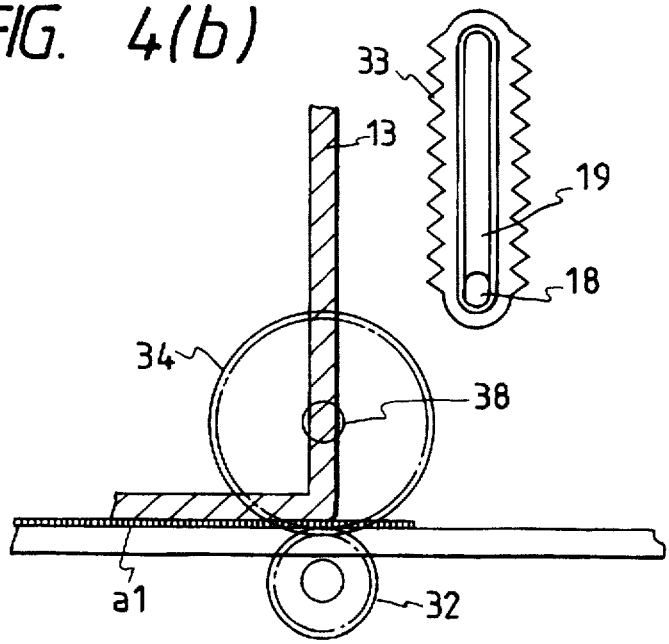

FIGS. 4(*a*) and 4(*b*) are explanatory diagrams showing a staple supply mechanism of the motor-driven stapler when it is viewed from the side thereof.

Figure 5:
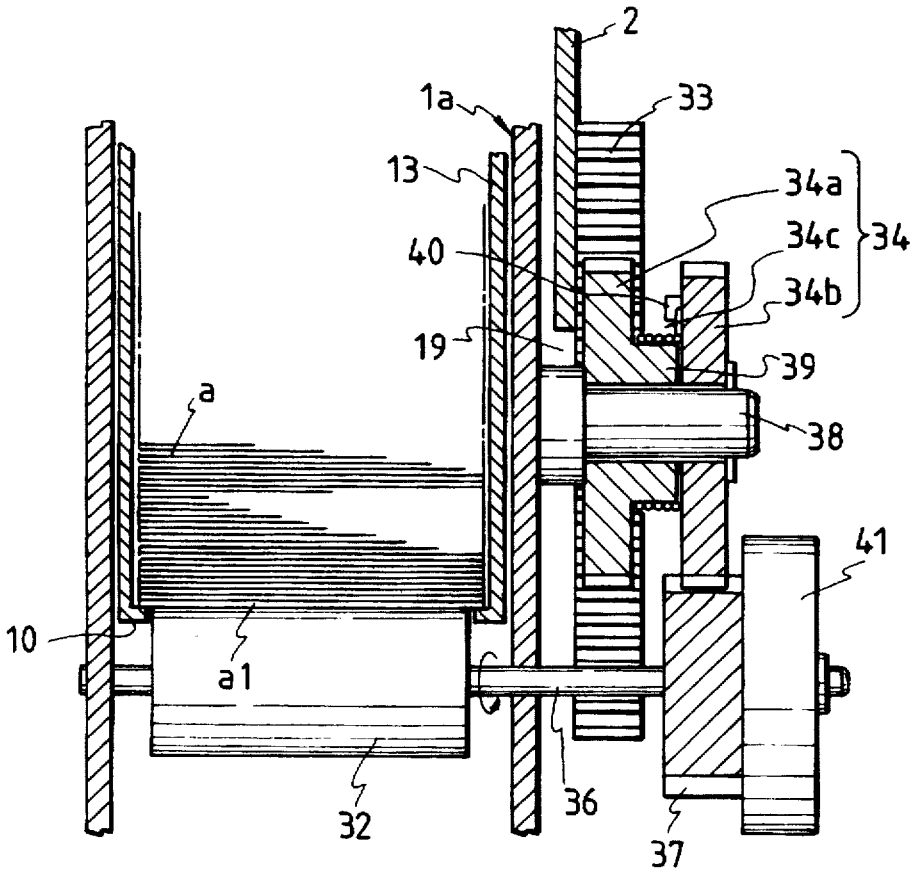

FIG. 5 is an explanatory diagram showing the staple supply mechanism when it is viewed from the front side thereof.

Figure 6A:
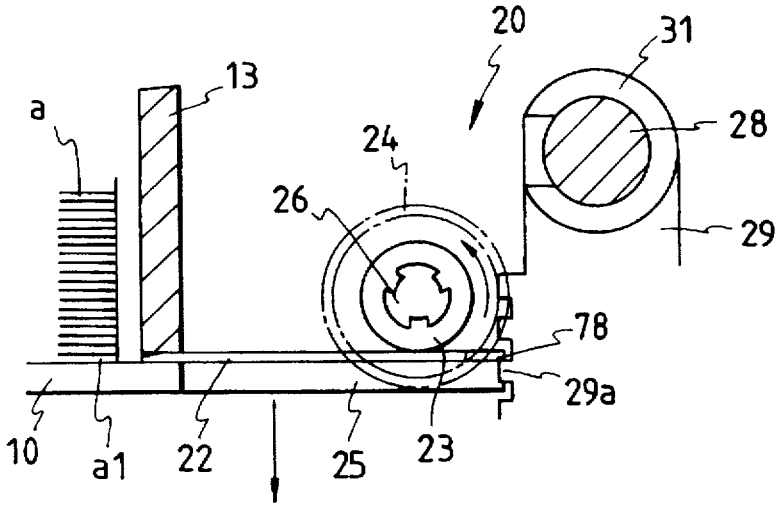
Figure 6B:
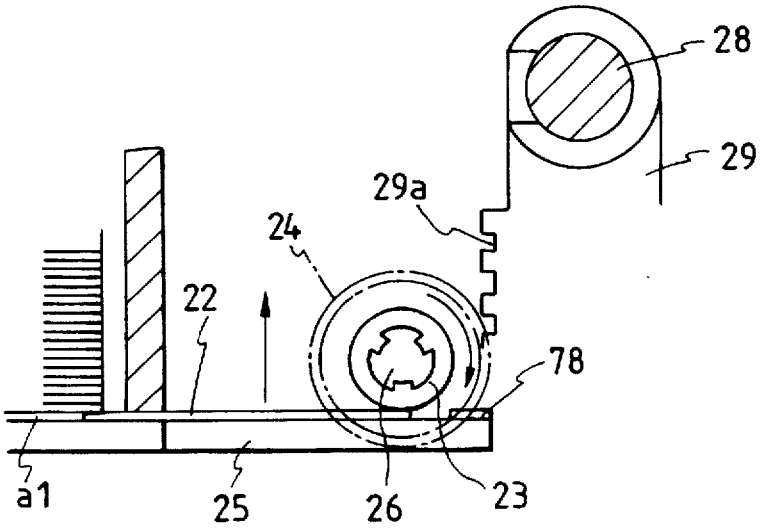

FIGS. 6(*a*) and 6(*b*) are diagrams showing the operation of a staple feed mechanism.

Figure 7:
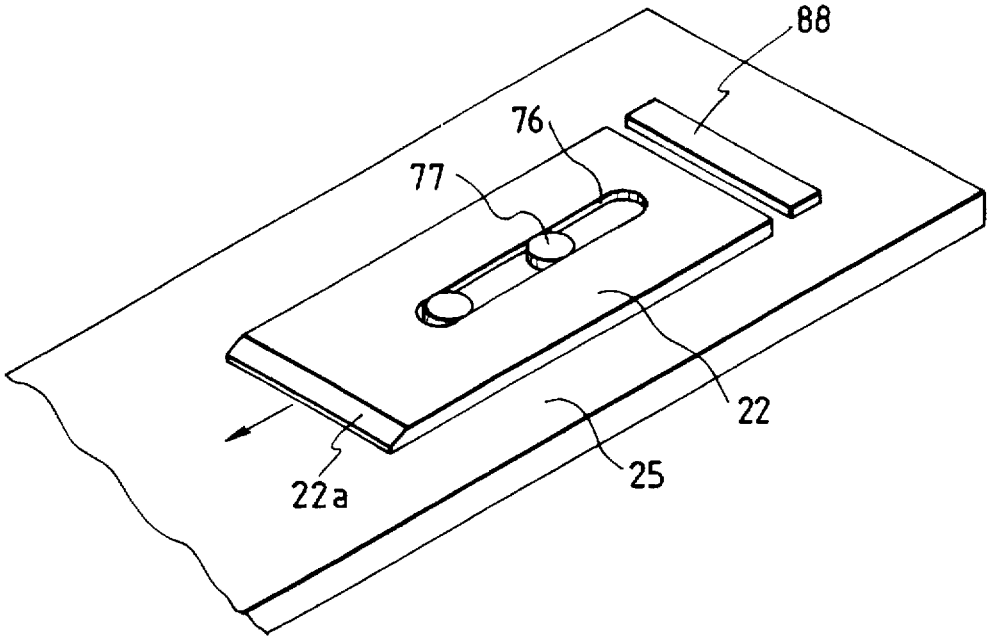

FIG. 7 is a perspective view showing a pusher and its related structure in the staple feed mechanism of the motor-driven stapler.

Figure 8:
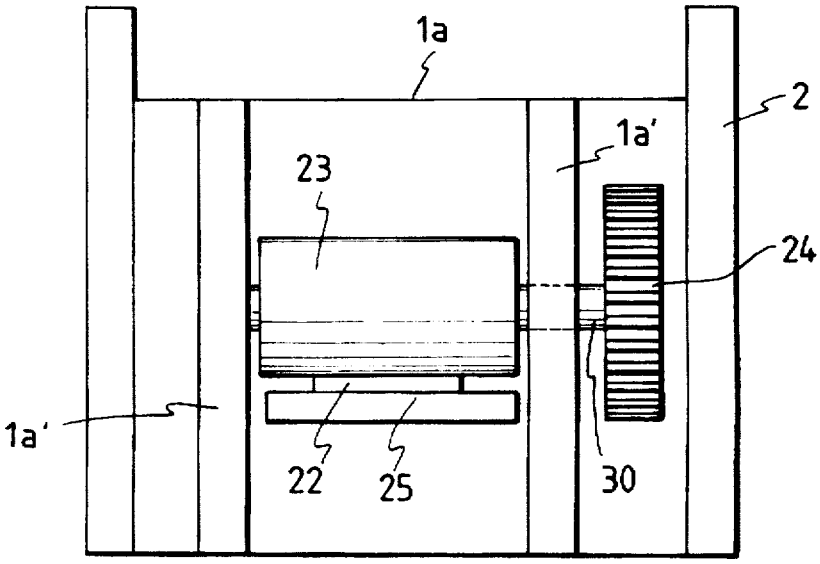

FIG. 8 is an explanatory diagram showing the staple feed mechanism when it is viewed from the rear side thereof.

Figure 9:
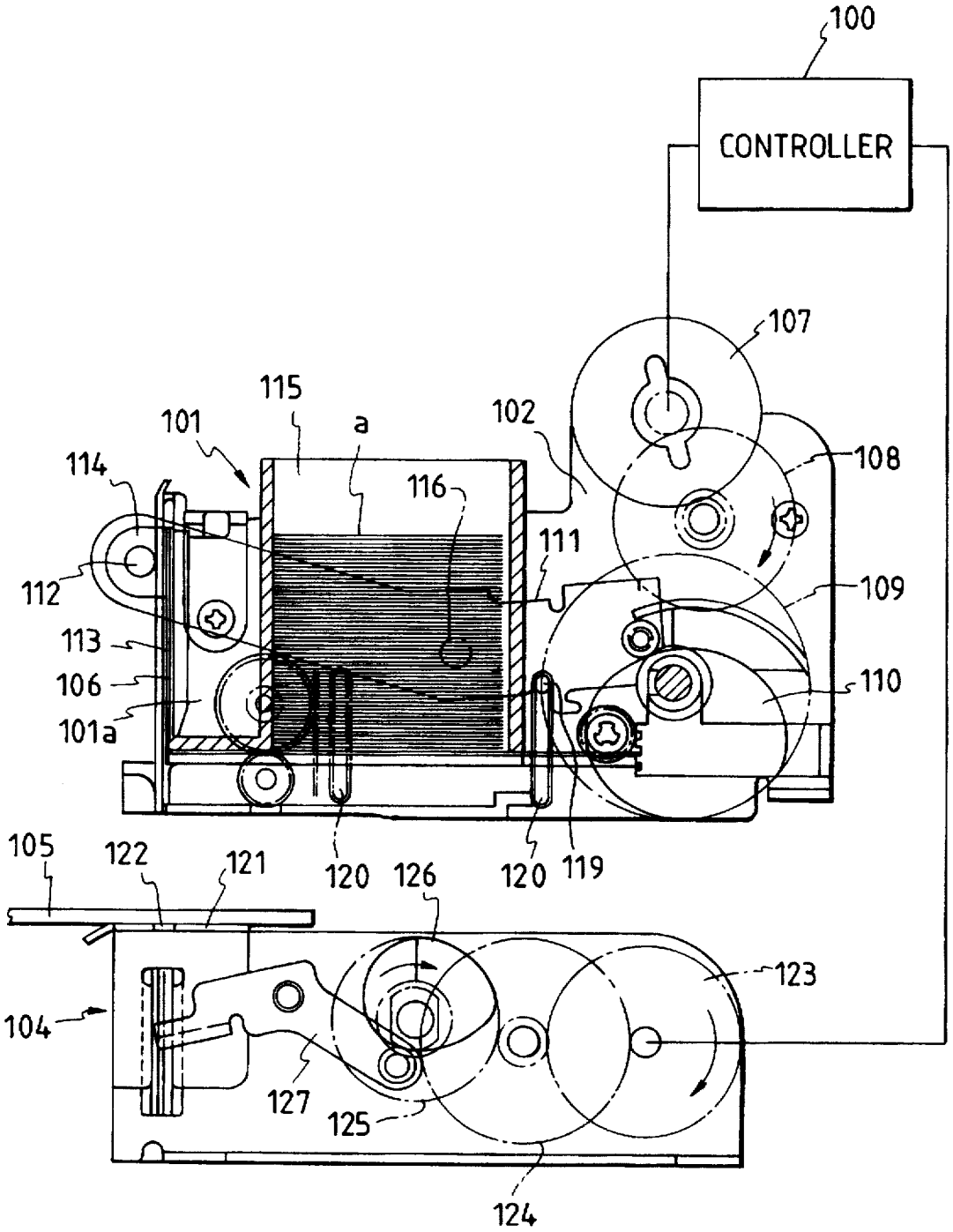

FIG. 9 is an explanatory diagram showing a state of a motor driven stapler according to another embodiment of the present invention before it is operated.

Figure 10:
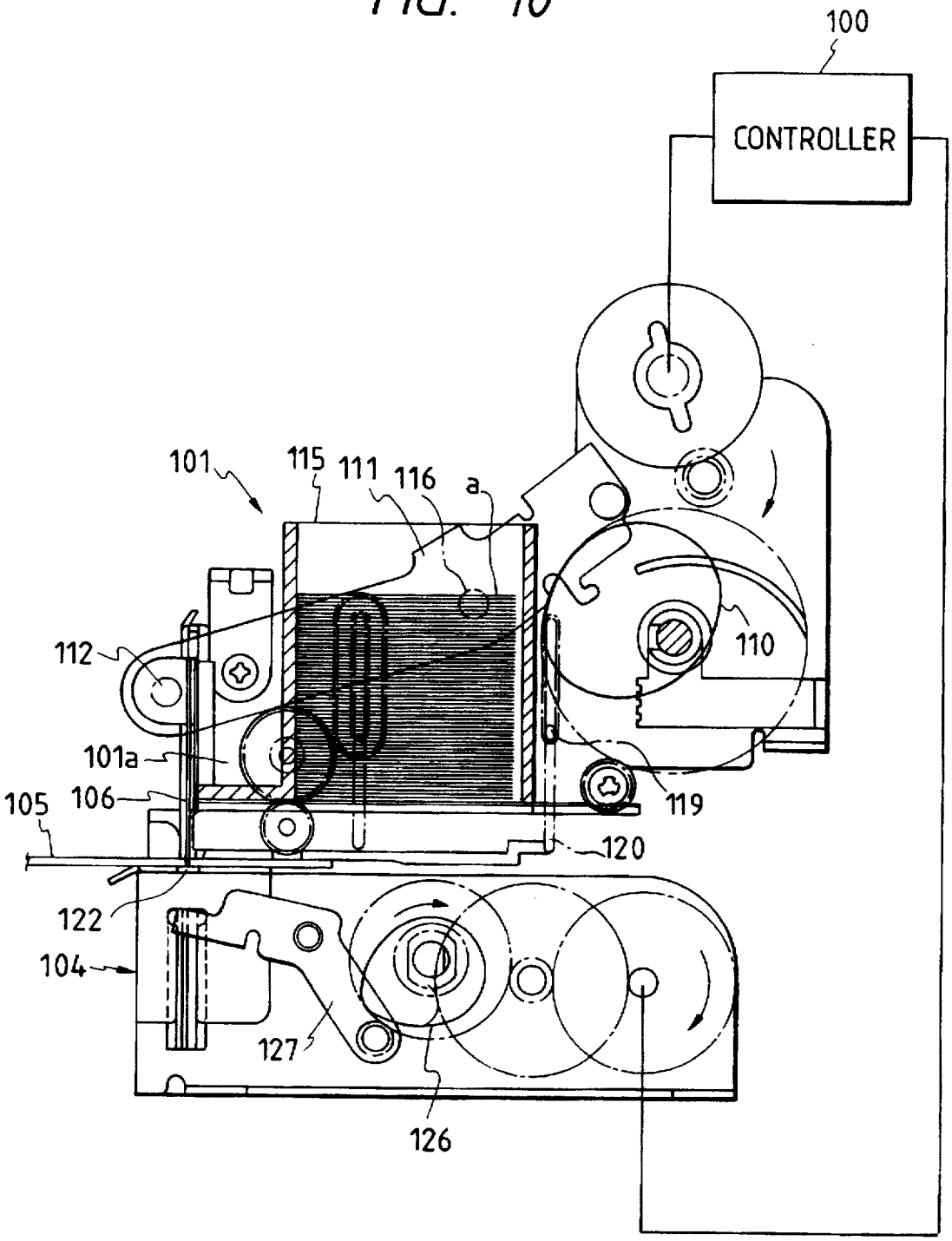

FIG. 10 is an explanatory diagram showing a state of a motor driven stapler according to another embodiment of the present invention when it operating.

Figure 11:
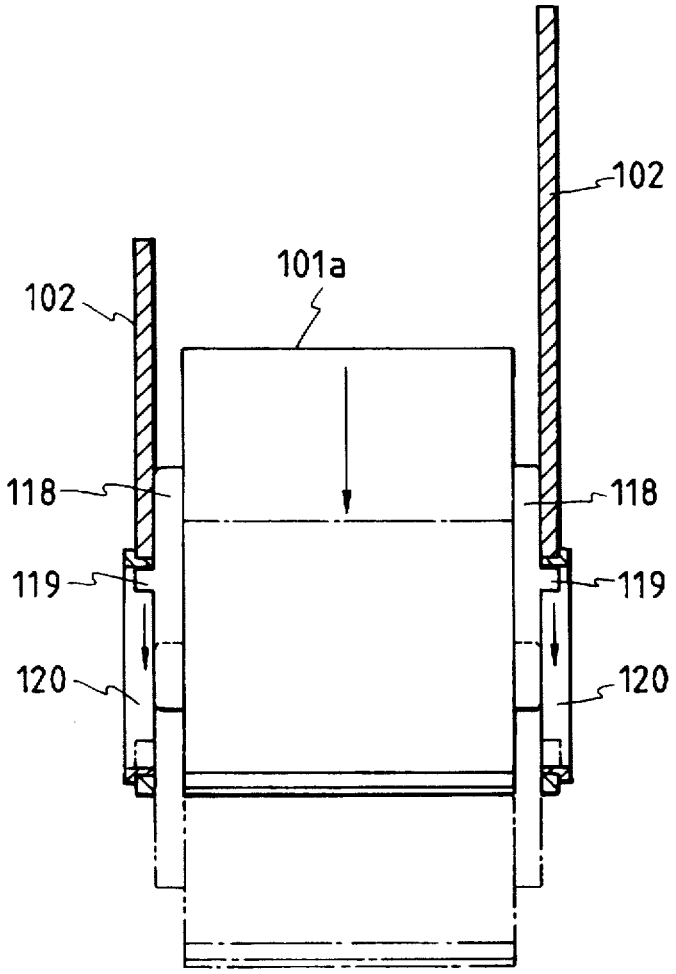

FIG. 11 is an explanatory diagram showing up and down movements of a magazine section.

Figure 12A:
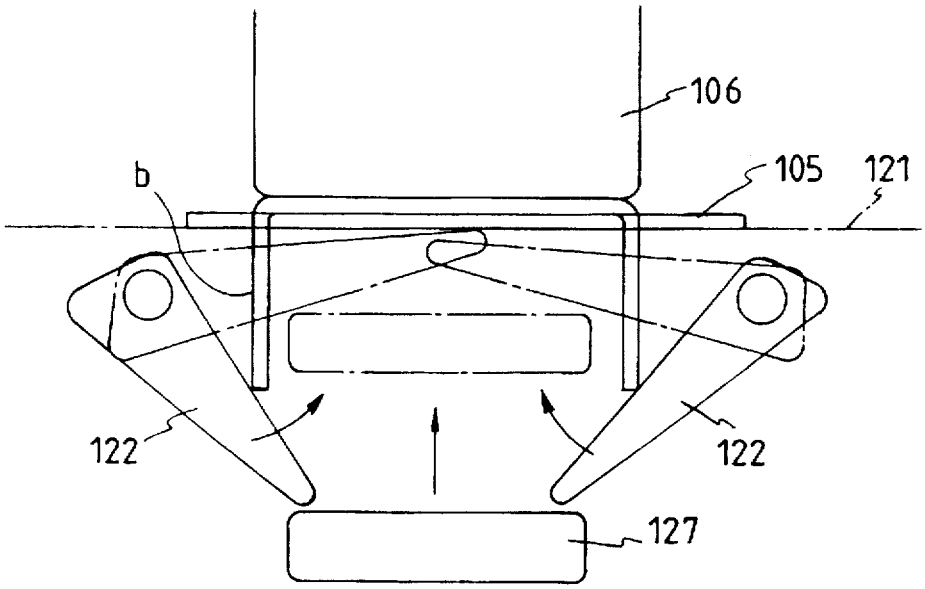
Figure 12B:
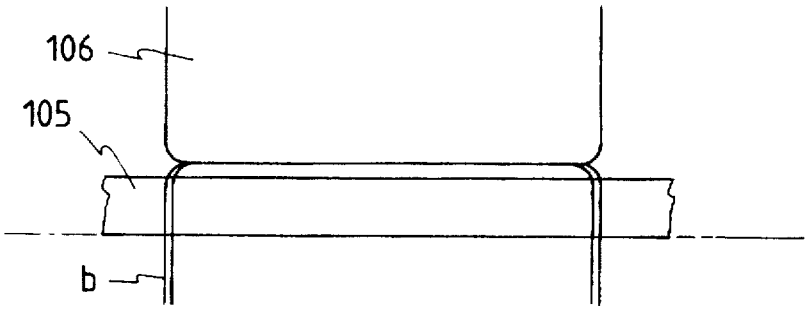

FIGS. 12(*a*) and 12(*b*) are explanatory diagrams showing respectively states of fastening together thin and thick papers.

Figure 13:
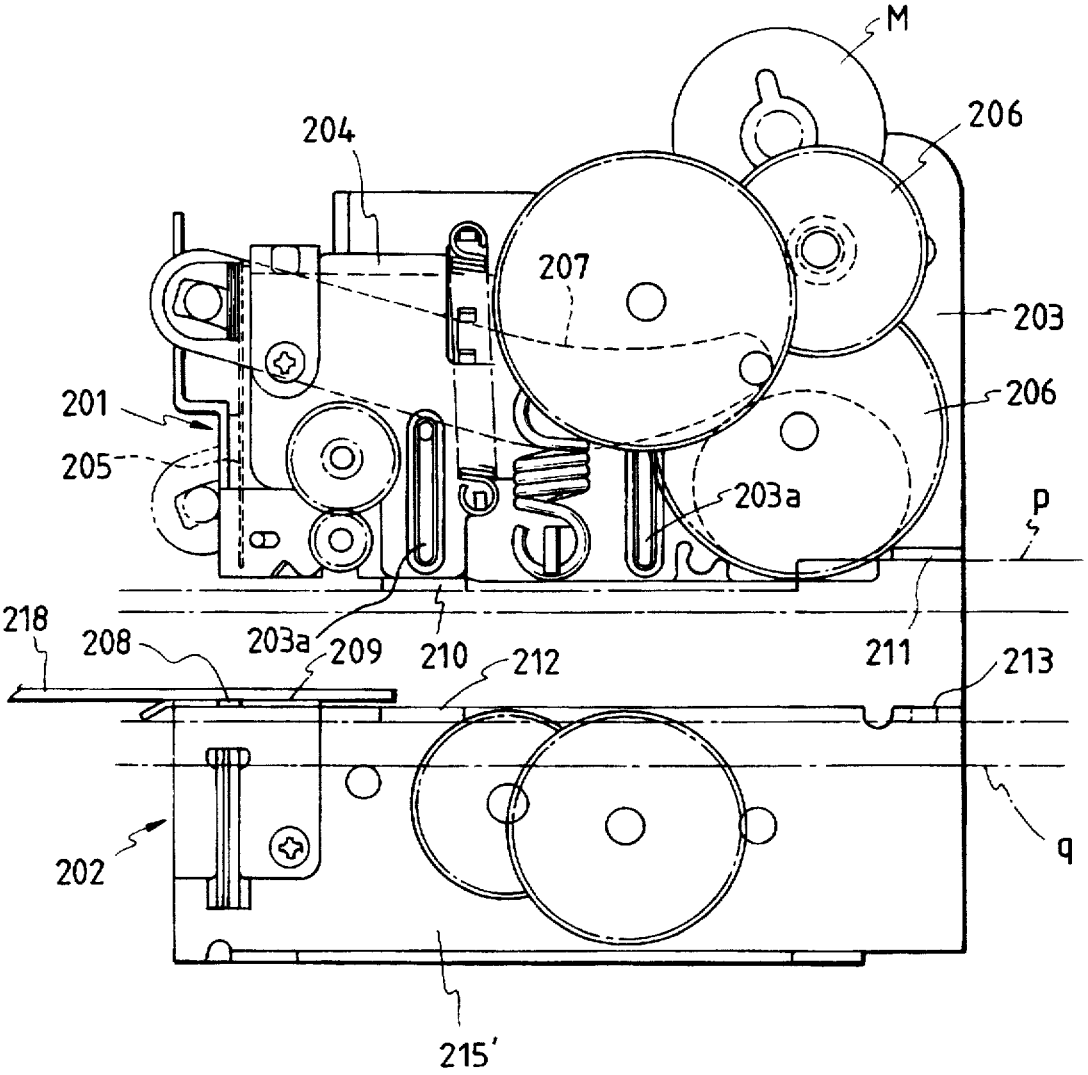

FIG. 13 is an explanatory diagram showing a positioning state of a separated type stapler according to another embodiment of the present invention before it is operated.

Figure 14:
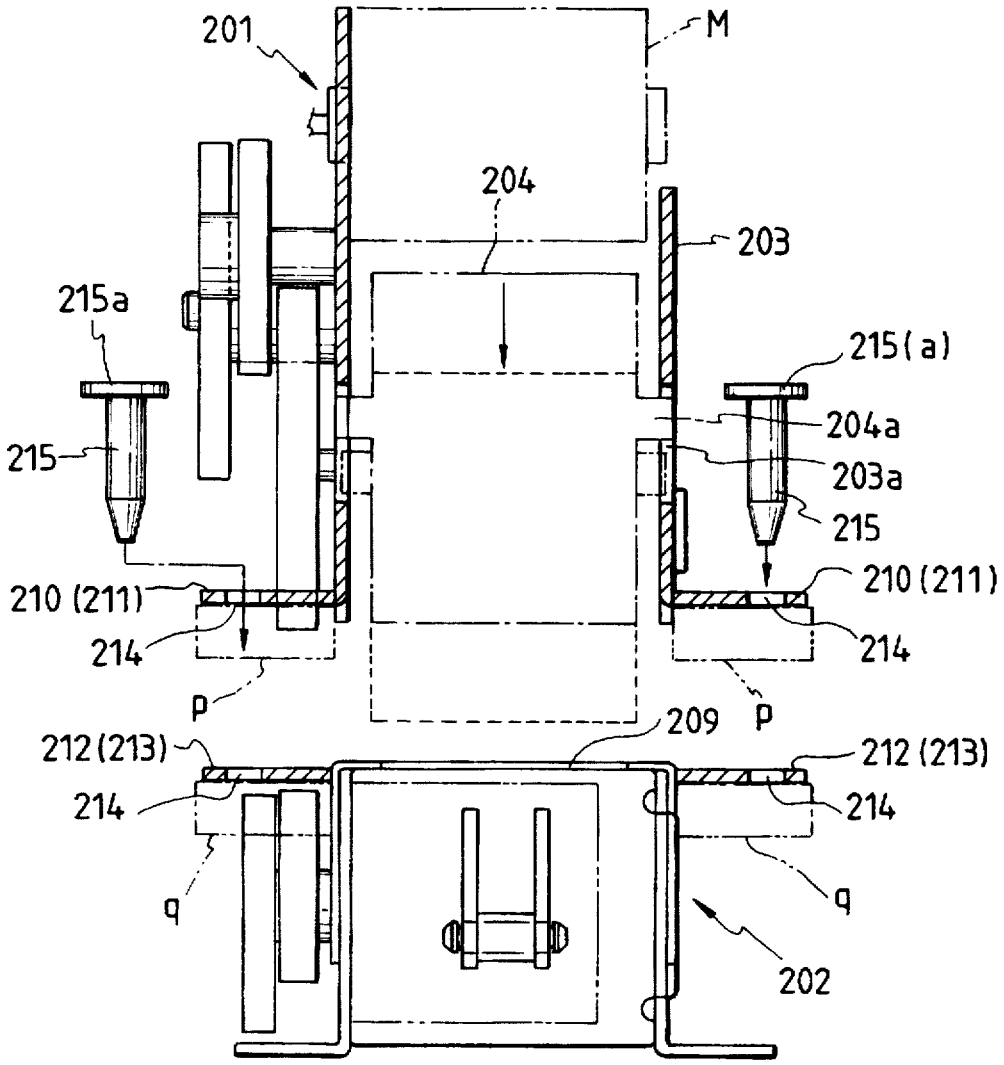

FIG. 14 is an explanatory diagram showing an operation of the separated type stapler shown in FIG. 13.

DETAILED DESCRIPTION OF THE PREFERRED EMBODIMENTS

Figure 1:
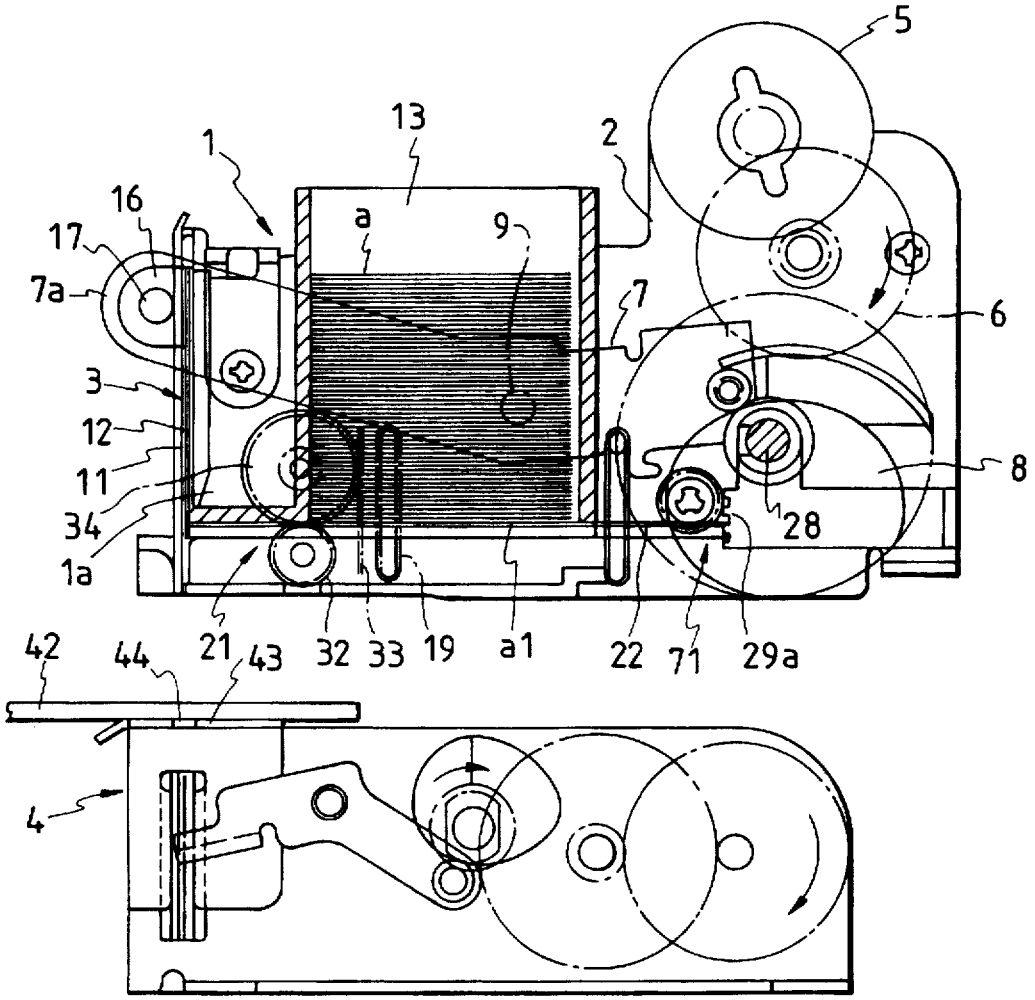
FIG. 1 is an explanatory diagram showing a motor-driven stapler before it operates.

Reference is made to FIG. 1 showing a motor-driven stapler. As shown, the motor-driven stapler is composed of a magazine section 1 and a clincher section 4 located under the magazine section 1. The magazine section 1, supported by a frame 2 (support means), is vertically movable. The magazine section 1 includes a driving means for driving staples that are stacked in a staple holder. The clincher section 4 receives the staple piece from a driving means 3 which is located at the front end of the magazine section 1, and bends the legs of the staple piece flat.

A motor 5 and a reduction gear 6 coupled with the motor 5 are coupled with the frame 2. A drive link 7 is rotatably supported at the mid portion by both side walls of the frame 2. The rear end of the drive link 7 engages a cam 8 integral with a final control gear 6*a*. The fore end of the magazine section 1 is coupled with the driving means 3 that is located at the fore end of the magazine section 1. Support shafts 9 project from the mid portion of the drive link 7. The support shafts 9 are supported by a vertically elongated hole of the frame 2.

In the magazine section 1, the magazine body 1*a* contains the staple holder and the driving means 3 therein. The staple holder consists of a cartridge 13 removably set. A staple takes the form of a sheet consisting of a series of glued straight staple pieces. A number of sheet-like staples a are stacked within the cartridge 13. The lowest staple a1 of the stacked staples is placed on a staple guide 10 shown in FIG. 5, and is to be fed out toward the driving means 3 by means of a staple supply mechanism to be given later. The driving means 3 on the magazine body 1*a* includes a forming plate 12 for forming the staple piece into a U-shaped staple piece, and a holder 16 for coupling the forming plate 12 with the driver plate 11. The holder 16 is projected forward through a slit of the front wall of the magazine body 1*a*. A coupling shaft 17, passing through the holder 16, is coupled with the front end 7*a* of the drive link 7. When the coupling shaft 17 moves, the combination of the driver plate 11 and the forming plate 12 moves along the inner surface of the front wall of the magazine body 1*a*.

The mechanism including the cartridge 13, the structure for feeding the staples out of the cartridge 13, and the structures for forming the staple pieces and driving the staple pieces is the same as that of a known motor-driven stapler. Hence, no further description of the mechanism and the structures will be given.

Figure 3:
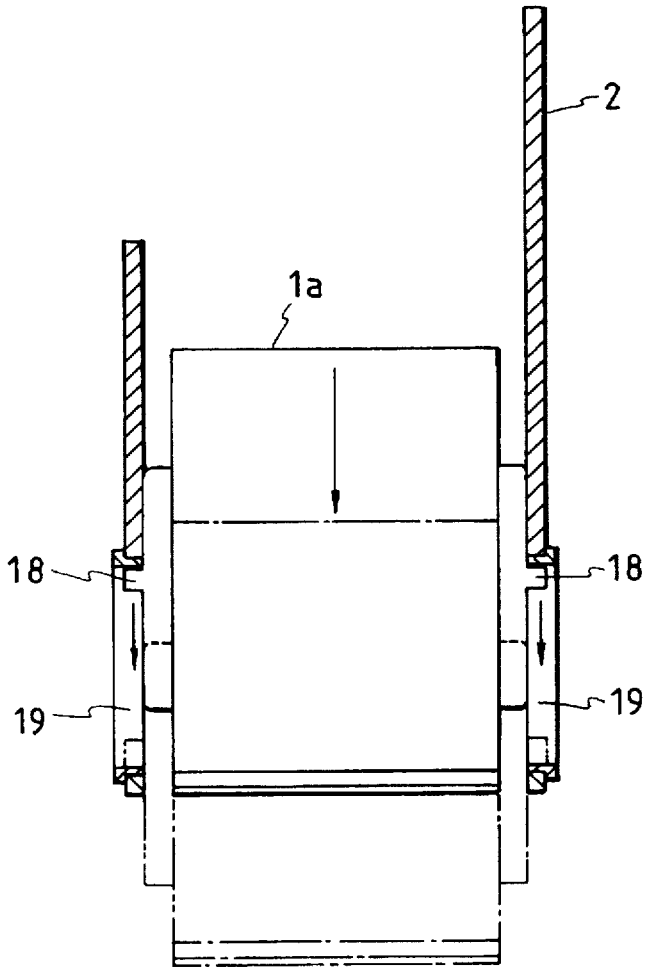
FIG. 3 is a diagram showing the operation of the magazine section of the motor-driven stapler.

As well illustrated in FIG. 3, protrusions 18 are protruded from the outside of the magazine body 1*a*. Vertically extended guide grooves 19 are formed in the frame 2. When assembled, the protrusions 18 are respectively inserted into the guide grooves 19 and are vertically movable along the guide grooves 19. In driving down the staple piece, the magazine body 1*a* moves to and from the clincher section 4. A staple supply mechanism for feeding the lowest staple a1 of the staple stack from the cartridge 13 to the driving section is located at the front side of the magazine section.

The staple supply mechanism includes a staple feed means 71 for feeding the sheet-like lowest staple a1 of the staple stack from the cartridge 13 by a preset quantity of staple feed, and a staple supply means 21 for further moving forward the lowest staple a1 to the driving section located at the front side of the magazine section.

The staple feed means 71 includes a plate-like pusher 22, a roller 23, and a drive gear 24. The pusher 22 confronts with the rear end face of the lowest staple a1 of the staple stack in the cartridge 13. The roller 23 is in press contact with the surface of the pusher 22 to move the pusher 22 forward and backward. The drive gear 24 drives the roller 23 to turn.

On the rear side of the cartridge 13 of the magazine section 1, a support plate 25 extends rearward from the staple guide 10, which supports the lower side of the sheet-like lowest staple a1. The pusher 22 is disposed on the support plate 25. As shown in FIG. 7, an elongated hole 76 is formed in the central part of the pusher 22. A protrusion 77, formed on the support plate 25, is slidably inserted in the elongated hole 76. With this structure, the pusher 22 is slidable along the hole on the support plate 25. The front edge 22*a* of the pusher 22 is shaped like a wedge. The front end thereof is equal to or thinner than the lowest staple a1. Further, the front end of the pusher stands facing the rear end of the lowest staple a1 of the staple stack in the cartridge 13. A stopper 88 is provided in the rear part of the support plate 25. The stopper 88 is used for stopping the rearward movement of the pusher 22.

The roller 23, which is in press contact with the surface of the pusher 22 to move forward and backward the pusher 22, is formed of rubber. As shown in FIG. 8 it is put on a drive gear 24, which is coaxial with a rotary shaft 26. The rotary shaft 26 is received by the bearings of the side walls 1*a*' of the magazine body 1*a*. The outer circumferential surface of the roller 23 is in press contact with the surface of the pusher 22. The rack member 29, disposed on the rear side of the magazine section 1, is in mesh with the drive gear 24, as shown in FIG. 6(*a*). The rack member 29 is integral with a bush 31 which supports a support shaft 28. One end of the rack member 29 is immovably coupled with the frame 2, while the other end thereof has a rack 29*a* in mesh with the drive gear 24.

A feed roller 32 is located near the exit port of the cartridge 13, loaded into the magazine section 1. The feed roller 32 is driven for rotation by drive means, explained later. This constitutes a secondary feed mechanism, which receives the sheet-like lowest staple a1, which is first fed from the cartridge 13 by the staple feed means 71, and further feeds it to the driving means 3.

In the structure of the clincher section 4, a movable clincher 44 is provided below a stitching table 43 on which the leading end of a set of papers 42 is placed. The movable clincher 44 is driven by a drive mechanism when a staple piece is driven through the papers 42. The movable clincher 44 may be substituted by a fixed type clincher, if required.

Figure 2:
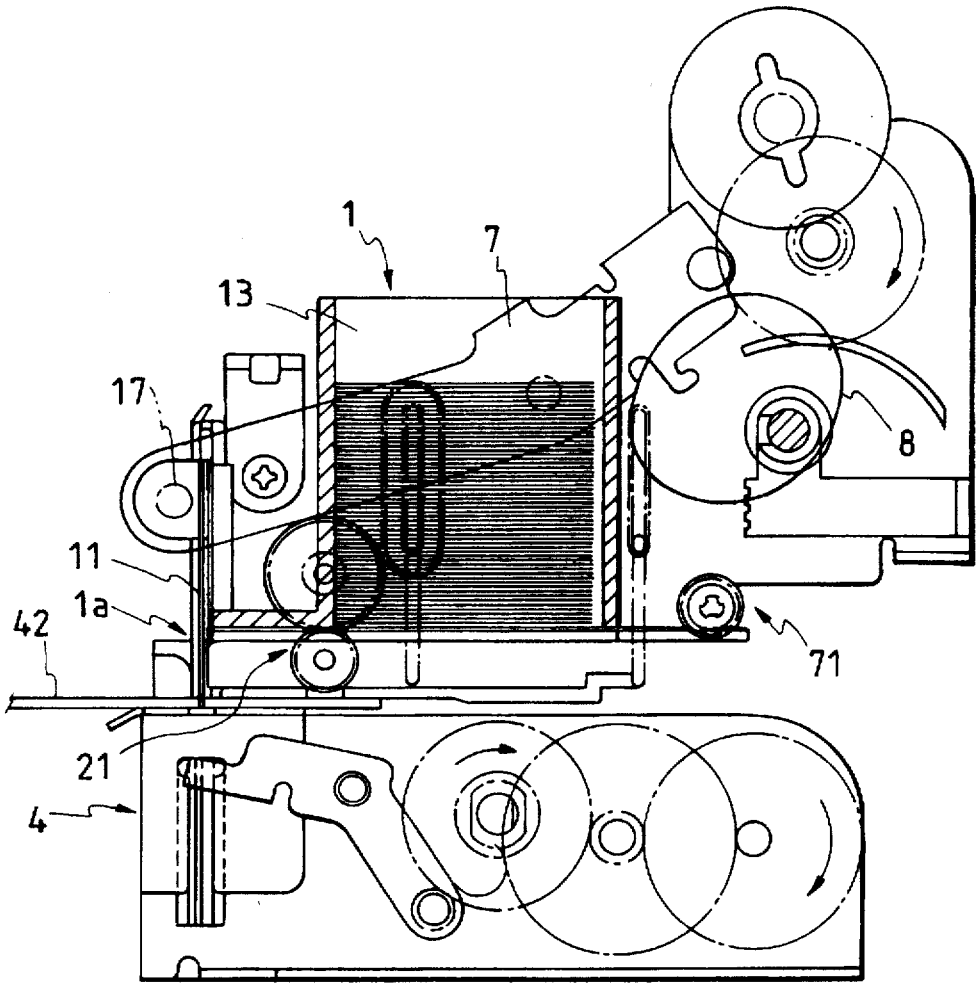
FIG. 2 is an explanatory diagram showing the motor-driven stapler when it is operating.

In operation, a set of papers 42 to be stitched is first set between the driving means 3 and the clincher section 4. The motor 5 of the magazine section 1 is operated. The cam 8 rotates with the reduction gear 6. The rear end of the drive link 7 is raised by the cam 8, and the drive link 7 is turned about the support shaft 9. The fore end of the drive link 7 moves downward. The coupling shaft 17 also moves downward (FIGS. 2 and 3). Accordingly, the driver plate 11 also moves downward. At this time, the magazine body 1*a* moves down in the direction substantially orthogonal to the papers 42 since a friction force acts between the component parts of the driving means and the magazine body 1*a*.

In a stapling mode as described above, the front end 7*a* of the drive link 7 moves downward with the turn of the cam 8. Accordingly, the magazine section 1 also moves down to approach to the clincher section 4. The drive gear 24, which has engaged the rack 29*a* of the rack member 29, rotates in the direction of an arrow in FIG. 6(*a*). With the rotation, the roller 23 is rotated in the same direction. When the roller 23 turns, the pusher 22, which is in a press contact with the roller 23, is moved backward and hits its rear end against the stopper 88 to come to a standstill.

After the stapling operation terminates, the front end 7*a* of the drive link 7 is turned upward. The magazine section 1 moves upward while departing from the clincher section 4. The drive gear 24, which is in mesh with the rack member 29, rotates in the direction of an arrow in FIG. 6(*b*). With the rotation, the pusher 22 is moved forward. Its fore end engages the rear end face of the sheet-like lowest staple a1 in the cartridge 13. The lowest staple a1 is fed forward along the staple guide 10. The front end of the sheet-like lowest staple al is transferred to the feed roller 32. The feed roller 32 feeds the staple to the driving means 3. It is shaped like U by the forming plate 12 when the magazine section 1 moves down in the next stapling operation. Then, the driver plate 11 drives the staple piece through the papers 42. More exactly, the legs of the staple piece are put through the papers 42. The movable clincher 44 of the clincher section 4 operates to bend the projected legs of the staple piece flat and the stapling of the papers 42 is complete. Following the stapling operation, the magazine section 1 is moved down again. The pusher 22 moves backward. The sheet-like lowest staple a1 is fed out of the cartridge 13. The sheet-like magazine body 1*a* located on the former descends and occupies the lowest place within the cartridge.

In the construction of the staple feed means 71 using the pusher 22, the pusher 22 pushes the rear end face of the sheet-like lowest staple a1 within the cartridge 13. Therefore, a reliable feed of the lowest staple is secured. The extent of the movement of the pusher 22 is determined by the rotation of the drive gear 24 in mesh with the rack 29*a* of the rack member 29. The extent of rotation of the drive gear 24 can be adjusted as desired by properly selecting a gear ratio of the combination of the rack 29*a* and the drive gear 24. Therefore, a reliable initial feed of the lowest staple a1 is ensured.

The construction of the staple feed means 71 is applicable for a motor-driven stapler of the type in which in driving the staple piece, the magazine section 1 is moved to and from the clincher section 4, such as the motor-driven stapler in which the bases of the magazine section 1 and the clincher section 4 are rotatably coupled with each other.

The staple supply means 21, as best illustrated in FIGS. 4 and 5, is constructed such that a feed roller 32 is coupled with a rack 33 by means of a one-way clutch gear 34.

The feed roller 32 is disposed at a location near the staple exit port of the front wall of the cartridge 13 loaded to the magazine section 1. The feed roller 32 is supported at both ends by the side walls of the magazine section 1. The upper surface of the feed roller 32 faces the staple guide 10.

A drive gear 37 is secured to one side of the support shaft 36 of the feed roller 32. The drive gear 37 is in mesh with the one-way clutch gear 34, which is rotatably supported by another support shaft 38 secured to the side wall of the magazine section 1. The one-way clutch gear 34 includes a first gear 34*a*, a second gear 34*b*, and a coiled, one-way clutch spring 34*c*. The first and second gears 34*a* and 34*b* are supported by the same shaft in a state that both face each other. The first gear 34*a* is integral with a tubular portion 39 on which the one-way clutch spring 34*c* is mounted. The first end of the one-way clutch spring 34*c* engages a protrusion 40 protruded from the side wall of the second gear 34*b*. With this structure, the first gear 34*a* is turned in the direction in which the first end of the one-way clutch spring 34*c* pushes the protrusion 40. The one-way clutch spring 34*c* is compressed, so that the first gear 34*a* and the one-way clutch spring 34*c* are coupled together. As a result, the rotation force of the first gear 34*a* is transferred to the second gear 34*b*, through the one-way clutch spring 34*c*. And the second gear 34*b* is also turned in the same direction. When the first gear 34*a* is turned in the direction in which the first end of the one-way clutch spring 34*c* separates from the protrusion 40, the one-way clutch spring 34*c* is released from the compressed state. Under this condition, the rotation force of the first gear 34*a* is not transferred to the second gear 34*b*, through the one-way clutch spring 34*c*. The first gear 34*a* runs idle and the second gear 34*b* does not turn.

The second gear 34*b* of the one-way clutch gear 34 is in mesh with the drive gear 37 coaxial with the feed roller 32. A rotary knob 41, manually operated, is integral with the drive gear 37.

The rack 33 extends along both sides of the longitudinally elongated, guide grooves 19. The rack 33 is in mesh with the first gear 34*a* of the one-way clutch gear 34.

In the structure of the clincher section 4, as shown in FIG. 1, a movable clincher 44 is provided above a stitching table 43 on which the leading end of a set of papers 42 is placed. The movable clincher 44 is driven by a drive mechanism when a staple piece is driven through the papers 42. As a matter of course, the clincher may be a fixed type clincher, if required.

In operation, a set of papers 42 is first set between the magazine section 1 and the clincher section 4. The motor 5 of the magazine section 1 is operated. The cam 8 rotates with the reduction gear 6. The rear end of the drive link 7 is raised by the cam 8, and the drive link 7 is turned about the support shaft 9. The fore end of the drive link 7 moves downward. The coupling shaft 17 also moves downward (FIG. 2). Accordingly, the driver plate 11 also moves downward. At this time, the magazine body 1*a* moves down in the direction substantially orthogonal to the papers 35 since a friction force acts between the component parts of the driving means and the magazine body 1*a*.

In a stapling mode as described above, the front end 7*a* of the drive link 7 moves downward with the turn of the cam 8. Accordingly, the magazine section 1 also moves down to approach to the clincher section 4. The drive gear 24, which has engaged the rack 29*a* of the rack member 29, rotates in the direction of an arrow in FIG. 6(*a*). With the rotation, the roller 23 is rotated in the same direction. As the roller 23 rotates, the pusher 22 in a press contact with the roller 23 is moved backward and hits its rear end against the stopper 88 to come to a standstill.

After the stapling operation terminates, the magazine section 1 moves upward while departing from the clincher section 4. The drive gear 24 in mesh with the rack member 29 rotates in the direction of an arrow in FIG. 6(*b*). With the rotation, the pusher 22 is moved forward. Its fore end engages the rear end face of the sheet-like lowest staple a1 in the cartridge 13. The lowest staple a1 is fed forward along the staple guide 10 to the staple supply means 21.

In the staple supply means 21, as shown in FIGS. 4 and 5, the first gear 34*a* of the one-way clutch gear 34 in the magazine section 1 comes to engage the rack 33 of the frame. Accordingly, when the magazine section 1 moves upward, the first gear 34*a* rotates. With the rotation of the first gear 34*a*, the second gear 34*b* and the drive gear 37 rotate. When the drive gear 37 rotates, the feed roller 32 also rotates. The sheet-like lowest staple a1 on the staple guide 10 is forwarded and supplied to the driving means 3. The sheet-like lowest staple a1 supplied is shaped like U by the forming plate 12. Then, the driver plate 11 moves downward to cut off the foremost staple piece from the U-shaped sheet-like lowest staple a1 and to drive its legs through the set of papers 42. Subsequently, the drive mechanism of the clincher section 4 operates to bend the legs flat and then the stapling operation is complete.

Also in the staple supply means 21, the magazine section 1 moves downward. The first gear 34*a* of the one-way clutch gear 34 reversely turns. However, the drive gear 37 is not turned, because the rotation force of the first gear 34*a* is not transferred to the second gear 34*b*.

As described above, in the staple supply means 21, the one-way clutch gear 34 allows the feed roller 32 to rotate always in the direction of feeding the sheet-like lowest staple. In other words, there is eliminated the reverse movement of the sheet-like lowest staple. Accordingly, a smooth supply of the sheet-like lowest staple is ensured.

The rotation of the feed roller 32 results from the rotation of the one-way clutch gear 34, which can be adjusted by a gear ratio of the combination of the one-way clutch gear 34 and the rack 33. Therefore, a sufficient quantity of feeding the sheet-like lowest staple is secured.

The feed roller 32 is rotated by utilizing the forward/backward motion of the magazine section 1 with respect to the clincher section. Thus special drive means for rotation is not required, leading to simple construction and reduction of a rate of failure occurrence.

The construction may be modified such that the rack 33 is in mesh with the drive gear 37 and the one-way clutch gear 34 is coaxially secured to the feed roller 32.

It is essential that the rack 33 moves relative to the magazine section 1. Therefore, it may be provided in the clincher section, while it is supported by the frame (support means) for supporting the magazine section 1.

It is evident that the construction of the staple supply means is applicable for a motor-driven stapler of the type in which the bases of the magazine section 1 and the clincher section 4 are rotatably coupled with each other or another motor-driven stapler in which the magazine section 1 and the clincher section 4 are immovably coupled with each other.

Reference is made to FIG. 9 showing a motor-driven stapler according to the another embodiment of the present invention. As shown, the motor-driven stapler is composed of a magazine section 101 and a clincher section 104 located under the magazine section 101. In the magazine section 101, a magazine body 1*a* for feeding a sheet-like staple out of a staple holder is supported by a frame 102. The clincher section 104 clinches flat the legs of a staple fed from the magazine section 101.

The frame 102 has a drive mechanism mounted thereon. The drive mechanism moves the magazine section 101 into contact with a set of papers 105 to be stitched and drives a driver plate 106. In the drive mechanism, a cam 110 is fastened to a drive gear 109, which is coupled with a motor 107 through a reduction gear 108. The rear end of a drive link 111, which is supported by support shafts 116 of the right and left side walls of the frame 102, is brought into contact with the cam 110. The fore end of the drive link 111 is coupled with a holder 114, through a link shaft 112. The holder 114 holds a forming plate 113 and the driver plate 106.

The staple takes the form of a sheet consisting of a series of glued staple pieces made of brass. The sheet-like staples are stacked within a cartridge 115 loaded into the magazine section 101. The stacked sheet-like staples a are successively fed toward the fore end of the magazine section 101 in a manner that the lowest staple of the staple stack is first fed, then the staple placed on the lowest staple is then fed, and so on. The staple thus fed is shaped like U by the forming plate 113. Then, the driver plate 106 hammers down the U-shaped staple piece through the lower part of the fore end of the magazine section 101.

The mechanism including the cartridge 115, the structure for feeding the staples out of the cartridge 115, and the structures for forming the staple pieces and driving down the staple pieces is the same as those of a known motor-driven stapler. Hence, no further description of the mechanism and the structures will be given.

As shown in FIG. 11, vertically elongated flat plate 118 horizontally extend on the side walls of the magazine body 1*a* of the magazine section 101. A protrusion 119 is protruded from each of the flat plates 118. Guide holes 120, in both side walls of the frame 102, are vertically elongated and parallel to each other. The protrusions 119 of the magazine section 101, respectively, are slidably inserted into the guide holes 120 so that the magazine body 1*a* is vertically movable with respect to the frame 102, while being guided by the vertically elongated guide holes 120.

The clincher section 104 includes a movable clincher 122 provided below a stitching table 121 on which the leading ends of the papers 105 are located, and a drive mechanism for driving the movable clincher 122. The drive mechanism includes a drive gear 125 coupled through a reduction gear 124 with a motor 123, a cam 126 coaxially fastened to the drive gear 125, and a drive link 127 which vertically swings with the rotation of the cam 126. As shown in FIG. 12(*a*), the movable part of the drive link 127 is disposed facing the lower ends of the movable clincher 122. With this structure, the drive link 127, when vertically swings, vertically turns the movable clincher 122. When the movable clincher 122 is turned upward, the legs b of the staple piece are clinched flat.

A control means for starting the operation of the drive mechanism for the movable clincher when the legs b of the staple piece are driven through the papers 105 is provided in the motor-driven stapler.

The control means is arranged such that when the legs of the staple piece are passed through a smallest number (two) of papers 105, the drive mechanism for the movable clincher 122 starts to operate. The driver plate 106 is positioned depending on a turn of the cam 126 from the initial position. Therefore, the control means may be arranged such that an encoder detects a present turn (e.g., 120°) of the cam and produces a detect signal, and the motor 123 for the movable clincher 122 is driven in response to the detected signal from the encoder. When the number of papers 105 to be stitched is large, the driver plate 106 can drive the staple piece through the set of papers with a shorter stroke than when the number of papers is small. Specifically, at a time point where the legs b of the staple piece are put through the set of papers 105, the turn angle of the cam 126 does not yet reach 120°. After a slight time elapse from that time point (viz., after the turn angle reaches 120°), the movable clincher 122 operates to bend the legs of the staple piece flat. Accordingly, any problem does not arise in the control timing of the controller.

In the motor-driven stapler, magazine section 101 and the clincher section 104 are mutually movable in the horizontal direction. Further, in a stapling mode, the magazine section 101 and the clincher section 104 must be vertically aligned with each other. An aligning mechanism (not shown) to realize the alignment of them is also provided in the motor-driven stapler.

In operation, the magazine section 101 and the clincher section 104 are first aligned with each other. A set of papers 105 to be stitched is inserted between the magazine section 101 and the clincher section 104. The motor 107 of the drive mechanism in the magazine section 101 is operated. The cam 110 turns with the turn of the reduction gear 108 thereby to push the rear end of the drive link 111 to swing the drive link 111 about the support shaft 116. At this time, the fore end of the drive link 111 moves downward to cause the link shaft 112 to move also downward (FIGS. 10 and 11). Accordingly, the driver plate 106 of the drive mechanism is also driven downward. At this time, a friction force acts between the component part of the drive mechanism and the magazine body 101*a*. Therefore, the magazine body 101*a* is guided by the guide holes 120 to move down with respect to the frame 102, in the direction orthogonal to the papers 105.

The magazine body 1*a* moves down until it contacts the surface of the set of papers 105. The driver plate 106 is moved further downward by the drive link 111. As a result, the driver plate 106 hammers down the staple piece to be put through the set of papers 105. At this time, the control means sends a signal to the motor 123 of the drive mechanism which in turn operates. The cam 126 turns, the drive link 127 swings, the movable clincher 122 operates, the legs b of the staple piece projected from the papers are bent flat, and the stapling operation is complete.

The stapled papers 105 may be discharged by passing through the space between the magazine section 101 and the clincher section 104. After the completion of the stapling operation, the drive link Ill swings in the opposite direction with the turn of the cam 110, so that the magazine section 101 moves upward.

As described above, the magazine section 101 moves in the direction orthogonal to the surface of the papers 105. Because of this, the driver plate 106 may be moved in the direction orthogonal to the papers 105 surface regardless of the thickness of the set of papers 105. As a result, the staple piece can always be set to the same position on the set of papers 105.

In the motor-driven stapler, two drive mechanisms independently operable are provided, one for the magazine section 101 and the other for the clincher section 104. In operation, the magazine section 101 operates to cause the staple piece to be put through the set of papers 105. At the instant that the staple piece is put through the set of papers, the drive mechanism of the clincher section 104 operates. Accordingly, the stitching operation stably proceeds while with little influenced by a variation of the motor speed of the motor 107.

As shown in FIGS. 13 and 14 showing a motor-driven stapler according to yet another embodiment of the present invention, the stapler consists of a driving section 201 and a clincher section 202.

In the driving section 201, the protrusions 204*a* protruded from both sides of a magazine portion 204 are respectively inserted into vertically elongated guide holes 203*a* of a frame 203, and vertically slidable therealong (see FIG. 14). A driver 205, provided on the front side thereof, hammers down staple pieces of a sheet-like staple fed out of the magazine portion 204, one by one. The sheet-like staple, consisting a series of glued staple pieces, is contained in a cartridge (not shown) removably set to the magazine portion 204. The cartridge is mounted on a preset location of the driving section 201.

A staple driving mechanism includes a drive link 207 driven by a force transferred through an intermediate gear 206 from a motor M, and the driver 205 operated by the drive link 207. The drive link 207 is driven to swing by the motor M. The swing motion is transformed into a vertical motion of the driver 205. The staple pieces fed forward by a feed mechanism, not shown, are driven down by the driver 205.

The clincher section 202 is provided with a clincher groove 208 for bending flat the legs of a staple piece driven down by the driving section 201. The clincher groove 208 may be of the fixed type in which it is integral with a stitching table 209. If required, it may be of a movable type.

The driving section 201 and the clincher section 202 may have the structure in which a staple driving section including a magazine of a known motor-driven stapler and a stitching table are vertically separated as disclosed in Published Unexamined Japanese Patent Application No. Hei. 1-71083.

Extended parts 210 and 211 are horizontally extended to the front and rear sides from the lower portion of the frame 203 of the driving section 201. Other extended parts are horizontally extended to the front and rear sides from the upper portion of a frame 215' of the clincher section 202. Those extended parts have positioning holes 214, respectively. The positioning holes are formed at such positions where the driving section 201 and the clincher section 202 are aligned with each other, viz., the driver 205 of the driving section 201 is aligned with the clincher groove 8 of the clincher section 202.

Pins 215 are fit into the positioning holes 214 of the horizontally-extended parts 210 to 213. The crown 215*a* of each pin 215 is extended in the direction orthogonal to the axis of the pin.

In constructing a motor-driven stapler in a manner that the driving section 201 and the clincher section 202 are attached to the locations p and q of other equipment, such as a copying machine, the pins 215 are fit into the positioning holes 214 of the driving section 1 and the clincher section 202. As a result, the driving section 1 and the clincher section 202 are positioned to be aligned with each other as required. In this aligned state, the driving section 201 and the clincher section 202 are attached to another equipment.

In operation, papers 218 to be stitched are set between the driving section 201 and the clincher section 202 and the motor M is operated. The magazine portion 204 of the driving section 201 slides down, and the driver 205 hammers down a staple piece toward the papers. The staple piece is put through the papers. The legs of the staple piece are pressed against the clincher groove 208 to be bent flat. As a result, the papers 218 are stitched. The stitched papers are discharged outside through the space between the driving section 201 and the clincher section 202.

Even in the motor-driven stapler of the type in which the driving section 201 and the clincher section 202 are separated, if it incorporates the positioning mechanism as described above thereinto, those separated sections can easily be positioned as desired by using the pins 215. Accordingly, the motor-driven stapler can be attached to other equipment so that those sections are accurately positioned.

While four extended parts and four pins are used for the positioning mechanism in the above-mentioned embodiment, provision of at least three extended parts and three pins suffices for the same purpose.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A stapler comprising:

a magazine section;

support means for supporting said magazine section so that said magazine section is vertically movable;

said magazine section including a staple driving portion including a staple driver plate, and means for feeding a staple to said staple driving portion in response to a vertical motion of said magazine section, whereby said staple is driveable by said staple driver plate; and a clincher section in opposed facing relation to said magazine section and operably aligned with said magazine section, said clincher section including a staple clincher, said magazine section being supported by said support means so as to move in a direction orthogonal to a surface of a table of the clincher, wherein said feeding means comprises:

a staple pusher constructed and arranged to feed a plurality of staples towards said staple driving portion;

a roller contacting a surface of said staple pusher:

a drive gear fixedly connected to said roller so as to be rotatable therewith; and a rack member intermeshed with said drive gear, wherein said rack member is disposed so as to cause relative motion between said drive gear and said rack member during the vertical motion of said magazine section.

2. A stapler according to claim 1, further comprising:

a drive mechanism for moving said staple clincher of said clincher section; and control means for actuating said drive mechanism when leg portions of said staple driven by said staple driver plate penetrate an article being stapled.

3. A stapler according to claim 2, further comprising:

means for aligning said magazine section relative to said clincher section.

4. A stapler according to claim 3, wherein said means for aligning comprises:

at least three positioning holes provided in one of said magazine section and said clincher section; and a number of pins corresponding to said at least three positioning holes, each pin being provided on an opposite one of said magazine section and said clincher section from a corresponding positioning hole, wherein said pins are receivable in said at least three positioning holes.

5. A stapler according to claim 1, further comprising:

means for aligning said magazine section relative to said clincher section while driving one of said plurality of staples with said staple driver plate.

6. A stapler according to claim 5, wherein said means for aligning comprises:

at least three positioning holes provided in one of said magazine section and said clincher section; and a number of pins corresponding to said at least three positioning holes, each pin being provided on an opposite one of said magazine section and said clincher section from a corresponding positioning hole, wherein said pins are receivable in said at least three positioning holes.

7. A stapler as in claim 1, wherein said means for feeding feeds in response to movement of said magazine section in a direction away from said clincher section.

8. A stapler as in claim 1, wherein said staple clincher section has a table in opposed facing relation to a stapling surface of said magazine section, and a movable clincher and a drive mechanism for driving the movable clincher.

9. A stapler comprising:

a magazine section;

support means for supporting said magazine section so that said magazine section is vertically movable;

said magazine section including a staple driving portion including a staple driver plate, and means for feeding a staple to said staple driving portion in response to a vertical motion of said magazine section, whereby said staple is driveable by said staple driver plate; and a clincher section in opposed facing relation to said magazine section and operably aligned with said magazine section, said clincher section including a staple clincher, said magazine section being supported by said support means so as to move in a direction orthogonal to a surface of a table of the clincher, wherein said feeding means comprises:

a feed roller mounted in said magazine section so as to contact a plurality of staples;

a one-way clutch gear fixedly connected to said feed roller; and a rack member intermeshed with said one-way clutch gear and constructed and arranged so that relative movement occurs between said one-way clutch gear and said rack member during the vertical movement of said magazine section, whereby said feed roller is rotated so as to feed said plurality of staples in a staple feeding direction only when said magazine section is moved away from said clincher section.

10. A stapler according to claim 9, wherein said magazine section includes guide means disposed on said magazine section for guiding the vertical movement of said magazine section, wherein said feeding means is formed on said guide means.

11. A stapler comprising:

a magazine section;

support means for supporting said magazine section so that said magazine section is vertically movable;

said magazine section including a staple driving portion including a staple driver plate, and means for feeding a staple to said staple driving portion in response to a vertical motion of said magazine section, whereby said staple is driveable by said staple driver plate; and a clincher section in opposed facing relation to said magazine section and operably aligned with said magazine section, said clincher section including a staple clincher, said magazine section being supported by said support means so as to move in a direction orthogonal to a surface of a table of the clincher, wherein said feeding means comprises:

a staple pusher constructed and arranged to feed a plurality of staples towards said staple driving portion;

a roller contacting a surface of said staple pusher;

a drive gear fixedly connected to said roller so as to be rotatable therewith;

a rack member intermeshed with said drive gear, wherein said rack member is disposed so as to cause relative motion between said drive gear and said rack member during the vertical motion of said magazine section;

a feed roller mounted in said magazine section so as to contact said plurality of staples;

a one-way clutch gear fixedly connected to said feed roller; and another rack member, said another rack member being intermeshed with said one-way clutch gear and constructed and arranged so that relative movement occurs between said one-way clutch gear and said another rack member during the vertical movement of said magazine section, whereby said feed roller is rotated so as to feed said plurality of staples in a staple feeding direction only when said magazine section is moved away from said clincher section.

12. A stapler according to claim 11, wherein said magazine section includes guide means disposed on said magazine section for guiding the vertical movement of said magazine section, wherein said feeding means is formed on said guide means.

13. A stapler comprising:

a magazine section;

support means for supporting said magazine section so that said magazine section is vertically movable; and a clincher section in facing relation to and operably aligned with said magazine section, said clincher section including a staple clincher, said magazine section including a staple driving mechanism and a staple feeder constructed and arranged to feed a plurality of staples to said staple driving mechanism in response to vertical motion of said magazine section away from said clincher section, said staple feeder comprising a feed roller mounted in said magazine section so as to contact said plurality of staples; a one-way clutch gear fixedly connected to said feed roller; and a rack member intermeshed with said one-way clutch gear and constructed and arranged so that relative movement occurs between said one-way clutch gear and said rack member during vertical movement of said magazine section, whereby said feed roller is rotated so as to feed said plurality of staples in a staple feeding direction only when said magazine section is moved away from said clincher section.

* * * * *